US009583261B2

(12) United States Patent
Mitani et al.

(10) Patent No.: US 9,583,261 B2
(45) Date of Patent: Feb. 28, 2017

(54) IRON POWDER FOR POWDER MAGNETIC CORE AND PROCESS FOR PRODUCING POWDER MAGNETIC CORE

(71) Applicant: Kobe Steel, Ltd., Kobe-shi (JP)

(72) Inventors: Hiroyuki Mitani, Kobe (JP); Takeo Miyamura, Kobe (JP); Hirofumi Hojo, Takasago (JP); Tomotsuna Kamijo, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 34 days.

(21) Appl. No.: 14/419,402

(22) PCT Filed: Aug. 26, 2013

(86) PCT No.: PCT/JP2013/072761

§ 371 (c)(1),
(2) Date: Feb. 3, 2015

(87) PCT Pub. No.: WO2014/034616

PCT Pub. Date: Mar. 6, 2014

(65) Prior Publication Data

US 2015/0187493 A1 Jul. 2, 2015

(30) Foreign Application Priority Data

Aug. 31, 2012 (JP) ..... 2012-192146

(51) Int. Cl.
*B22F 3/02* (2006.01)
*H01F 41/02* (2006.01)
(Continued)

(52) U.S. Cl.
CPC ..... *H01F 41/0246* (2013.01); *B22F 1/02* (2013.01); *B22F 3/02* (2013.01); *H01F 1/147* (2013.01);
(Continued)

(58) Field of Classification Search
None
See application file for complete search history.

(56) References Cited

U.S. PATENT DOCUMENTS 6,464,750 B1 * 10/2002 Tailhades ..... B22F 1/004 72/245
2003/0077448 A1 4/2003 Ueta et al.
(Continued)

FOREIGN PATENT DOCUMENTS

CN 1381852 A 11/2002
CN 102623122 A * 8/2012
(Continued)

OTHER PUBLICATIONS

Machine translation of JP-2008-063650A (no date available).*
(Continued)

*Primary Examiner* — Kiley Stoner
(74) *Attorney, Agent, or Firm* — Oblon, McClelland, Maier & Neustadt, L.L.P.

(57) ABSTRACT

A powder magnetic core which exhibits a high compact density and a reduced iron loss can be obtained by compacting a soft magnetic powder in which the mass ratio of soft magnetic powder particles that pass through a filter having an opening of 75 μm is 95 mass % or higher relative to the whole amount of the soft magnetic powder and which has a mean strain of less than 0.100%.

19 Claims, 3 Drawing Sheets

(51) Int. Cl.

| | |
|---|---|
| ***H01F 1/24*** | (2006.01) |
| ***B22F 1/02*** | (2006.01) |
| ***H01F 1/147*** | (2006.01) |
| ***H01F 1/20*** | (2006.01) |
| ***H01F 1/22*** | (2006.01) |
| *B22F 5/00* | (2006.01) |

(52) U.S. Cl.

CPC ..... *H01F 1/20* (2013.01); *H01F 1/22* (2013.01); *H01F 1/24* (2013.01); *B22F 5/00* (2013.01); *B22F 2999/00* (2013.01); *C22C 2202/02* (2013.01)

(56) References Cited

U.S. PATENT DOCUMENTS

| | | | | |
|---|---|---|---|---|
| 2005/0254989 | A1* | 11/2005 | Fujiwara | H01F 1/15308 420/8 |
| 2006/0165985 | A1* | 7/2006 | Matsukawa | H01F 1/26 428/384 |
| 2006/0170524 | A1* | 8/2006 | Fujiwara | H01F 1/15366 336/83 |
| 2007/0175545 | A1* | 8/2007 | Urata | B22F 9/002 148/304 |
| 2009/0226751 | A1 | 9/2009 | Mitani et al. | |
| 2009/0295518 | A1 | 12/2009 | Nishi et al. | |
| 2010/0188179 | A1* | 7/2010 | Mitani | B22F 1/02 335/297 |
| 2010/0212455 | A1* | 8/2010 | Ohwaki | B22F 1/02 75/246 |
| 2011/0115599 | A1* | 5/2011 | Otsuki | H01F 1/26 336/221 |
| 2011/0227679 | A1 | 9/2011 | Koeda et al. | |
| 2012/0154083 | A1* | 6/2012 | Ohwaki | H01F 1/26 335/297 |
| 2012/0164453 | A1 | 6/2012 | Hojo et al. | |
| 2012/0211693 | A1* | 8/2012 | Skarman | B22F 1/0062 252/62.55 |
| 2013/0015394 | A1* | 1/2013 | Skarman | B22F 1/02 252/62.55 |
| 2013/0181804 | A1* | 7/2013 | Miyamura | H01F 1/01 336/233 |
| 2014/0002219 | A1* | 1/2014 | Mitani | H01F 1/26 335/297 |
| 2015/0022301 | A1* | 1/2015 | Esaki | H01F 1/26 336/83 |
| 2015/0243420 | A1* | 8/2015 | Miyamura | H01F 1/20 75/252 |
| 2015/0270050 | A1* | 9/2015 | Uemoto | H01F 1/26 336/233 |

FOREIGN PATENT DOCUMENTS

| | | |
|---|---|---|
| EP | 1 246 209 A2 | 10/2002 |
| JP | 11-286703 A | 10/1999 |
| JP | 2006 283166 | 10/2006 |
| JP | 2007 231415 | 9/2007 |
| JP | 2008 63650 | 3/2008 |
| JP | 2008 63652 | 3/2008 |
| JP | 2008-270285 | 6/2008 |
| JP | 2009 32860 | 2/2009 |
| JP | 2009 32880 | 2/2009 |
| JP | 2009 200325 | 9/2009 |
| JP | 2010-245459 | 10/2010 |
| JP | 2011-216839 | 10/2011 |
| JP | 2012 140679 | 7/2012 |

OTHER PUBLICATIONS

Machine translation of JP-2006-283166A (no date available).*

International Search Report and Written Opinion of the International Searching Authority Issued Nov. 26, 2013 in PCT/JP13/072761 Filed Aug. 26, 2013.

Takajo, Shigeaki, Thesis Paper entitled "Study of Magnetic Property Analysis and Manufacture of Iron Powder Compact and Sintered Core Material," p. 27, Jun. 13, 1990, with partial English translation, 5 pages.

German, Randall M., Powder Metallurgy of Iron and Steel, p. 28, 1998, 4 pages.

Monma, Kaizo, Physical Metallurgy of Steel, Revised Edition, pp. 6-7, 1995, with partial English translation, 7 pages.

Waseda, Yoshio, et al., X-Ray Structure Analysis, Determination of Atomic Arrangement, pp. 10-11, 2007, with partial English translation, 6 pages.

* cited by examiner

IRON POWDER FOR POWDER MAGNETIC CORE AND PROCESS FOR PRODUCING POWDER MAGNETIC CORE

TECHNICAL FIELD

The present invention relates to a method for producing a powder magnetic core by compacting a soft magnetic powder. The powder magnetic core obtained by the production method of the present invention has excellent magnetic properties, in particular, a low iron loss and a high density and thus has a high magnetic flux density. The present invention also relates to the soft magnetic powder provided for the production method of the present invention.

BACKGROUND ART

An electromagnetic component such as an inductor and a motor generally has a structural unit made by forming an electrical conductor coil around a magnetic core (a core). In recent years, the use of the powder magnetic core as a magnetic core (a core) has been studied. The powder magnetic core is produced by compacting a soft magnetic powder and has isotropic magnetic properties. Therefore, the powder magnetic core enables a three-dimensional magnetic circuit to be designed and can contribute to production of smaller and lighter electromagnetic components.

Examples of the magnetic properties that a magnetic material exhibits when the magnetic material is magnetized include an iron loss, a magnetic flux density, a coercive force, and frequency characteristics. Examples of the magnetic properties that are important for the powder magnetic core include the iron loss and the magnetic flux density.

The iron loss is an energy loss generated in a magnetic substance when an alternating magnetic field is applied into the ferromagnetic substance. The electromagnetic component such as an inductor and a motor is often used in the alternating magnetic field and thus reduction in the iron loss of the powder magnetic core used for the electromagnetic component from the viewpoint of improvement of electromagnetic conversion characteristics.

The iron loss is represented by the sum of a hysteresis loss and an eddy current loss when the region does not include the relaxation phenomenon of the magnetic flux change in the material (such as magnetic resonance). The hysteresis loss is proportional to a driving frequency and the eddy current loss is proportional to the square of the driving frequency. Consequently, when the driving frequency is a high frequency (for example, more than 1 kHz), the effect of the eddy current loss on the iron loss is large, while when the driving frequency is low frequency (for example, several hundred Hz to 1 kHz), the effect of the hysteresis loss on the iron loss is large.

Among the electromagnetic components, the inductor and a reactor are used under a high drive frequency. As a result, reduction in the eddy current loss is important. It has been known that reduction in the eddy current loss can be achieved by covering the surfaces of iron based particles with insulating coating films. Generation of eddy current flowed across the particles can be suppressed by covering the surfaces of the iron based particles with the insulating coating films. By this treatment, the eddy current is localized in each particle and thus the eddy current loss can be reduced as a whole. As the insulating coating film, an insulating inorganic coating film (for example, a phosphate conversion coating film, a water glass coating film, and an oxide coating film) and a resin coating film (for example, a silicone resin coating film) are used. In order to reduce the eddy current loss, a soft magnetic powder having smaller particle size is also effective (for example, Patent Literature 1).

Among the electromagnetic components, the motor and the like are used under a low drive frequency. As a result, reduction in the hysteresis loss is important. It has been known that thermal treatment is recommended to be applied to a compact obtained by compacting the soft magnetic powder in order to reduce the hysteresis loss. In other words, the hysteresis loss has strong correlation to the coercive force. Therefore, as the strain introduced into the compact is increased, the coercive force of the powder magnetic core is increased. Consequently, the coercive force of the powder magnetic core becomes smaller when the thermal treatment (strain release annealing) is applied after compacting to release the introduced strain. As a result, the hysteresis loss of the powder magnetic core becomes smaller.

In order to increase the magnetic flux density, the magnetic flux density of the soft magnetic powder itself is required to be increased and thus a pure iron powder containing less impurity elements is preferable. The magnetic flux density can also be increased by increasing the compact density of the powder magnetic core.

CITATION LIST

Patent Literature

Patent Literature 1: Japanese Patent Application Publication No. 2009-32880 (Page 6 to 9 and Table 2)

SUMMARY OF INVENTION

Technical Problem

An iron based raw material powder that is a raw material for the powder magnetic core often has oxidized surfaces and thus reduction annealing is required to be carried out. The reduction annealing is carried out under a reducing atmosphere such as a hydrogen atmosphere at 900° C. or more and 1250° C. or less. When the reduction annealing is carried out at a high temperature of 900° C. or more and 1250° C. or less, sintering of the iron based raw material powder progresses and adjacent particles of the iron based raw material powder are fused and bonded with each other. Consequently, it has been known that an iron based reduced powder is recommended to be pulverized and the iron based pulverized powder is recommended to be classified in order to obtain the soft magnetic powder having a desired particle size. However, when a powder magnetic core is compacted by using the soft magnetic powder obtained by such a method, sufficient magnetic properties may fail to be obtained in some cases.

The present invention is achieved to solve the problems as described above and the purpose of the present invention is to provide a method for producing the powder magnetic core having a high compact density and a reduced iron loss.

Solution to Problem

As the gist, a method for producing a powder magnetic core (a first production method) according to the present invention that can solve the problems described above includes the step of compacting a soft magnetic powder including soft magnetic powder particles that pass through a sieve having an opening of 75 μm being in a mass ratio of 95% by mass or more relative to the whole amount of the soft magnetic powder, in which the soft magnetic powder has a mean strain of less than 0.100%.

The soft magnetic powder is preferably iron based particles having insulating layers on the surfaces of the iron based particles.

The powder magnetic core obtained by the first production method is preferably the core of an inductor.

A soft magnetic powder for a powder magnetic core (a first soft magnetic powder) that can solve the problems described above includes soft magnetic powder particles that pass through a sieve having an opening of 75 μm being in a mass ratio of 95% by mass or more relative to the whole amount of the soft magnetic powder, in which the soft magnetic powder has a mean strain of less than 0.100%.

The soft magnetic powder is preferably iron based particles having insulating layers on the surfaces of the particles.

As the gist, a method for producing a powder magnetic core (a second production method) according to the present invention includes the step of compacting a soft magnetic powder including soft magnetic powder particles that pass through a sieve having an opening of 600 vim being in a mass ratio of 98% by mass or more relative to the whole amount of the soft magnetic powder, in which the soft magnetic powder has a mean strain of less than 0.050%.

The soft magnetic powder is preferably iron based particles having insulating layers on the surfaces of the particles.

The powder magnetic core obtained by the second production method is preferably the rotor of a motor or the core of a stator.

A soft magnetic powder for a powder magnetic core (a second soft magnetic powder) according to the present invention includes soft magnetic powder particles that pass through a sieve having an opening of 600 vim being in a mass ratio of 98% by mass or more relative to the whole amount of the soft magnetic powder, in which the soft magnetic powder has a mean strain of less than 0.050%.

The soft magnetic powder is preferably iron based particles having insulating layers on the surfaces of the particles.

Effects of Invention

According to the production method (the first production method) of the present invention, the powder magnetic core having a reduced iron loss, an increased compact density, and an increased magnetic flux density can be produced because the powder magnetic core is produced by compacting the soft magnetic powder (the first soft magnetic powder) including soft magnetic powder particles that pass through a sieve having an opening of 75 vim being in a mass ratio of 95% by mass or more, in which the soft magnetic powder has a mean strain of less than 0.100%.

According to the production method (the second production method) of the present invention, the powder magnetic core having a reduced iron loss, an increased compact density, and an increased magnetic flux density can be produced because the powder magnetic core is produced by compacting a soft magnetic powder (the second soft magnetic powder) including soft magnetic powder particles that pass through a sieve having an opening of 600 μm being in a mass ratio of 98% mass or more, in which the soft magnetic powder has a mean strain of less than 0.050%.

According to the present invention, when a block-like or a sheet-like iron based reduced powder obtained by reduction annealing of the iron based raw material powder is pulverized, a degree of pulverization can be evaluated by a strain as an index, which is industrially advantageous.

DESCRIPTION OF EMBODIMENTS

Figure 1:
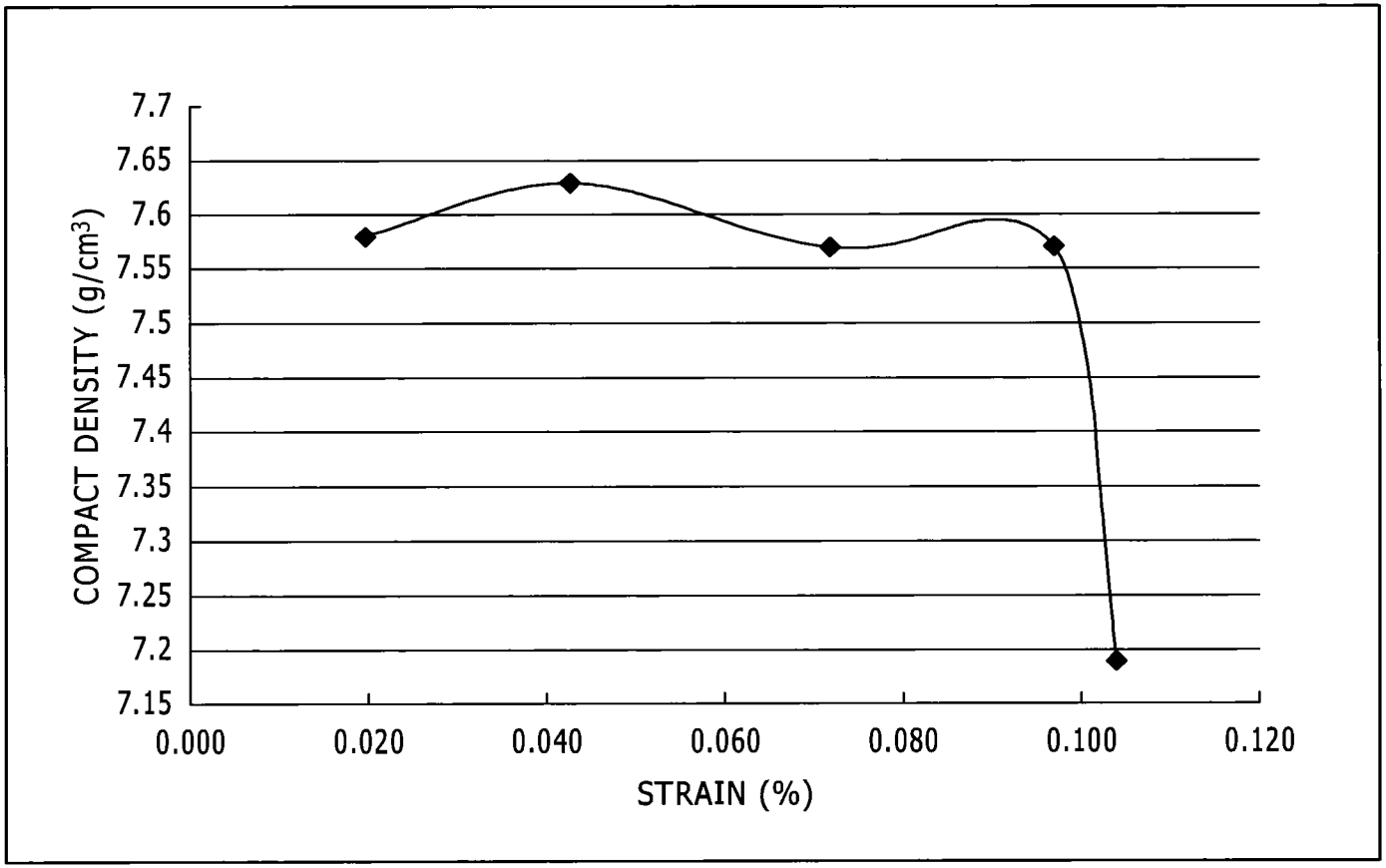
FIG. 1 is a graph obtained by plotting the compact density of powder magnetic cores obtained in Inventive Examples 1 to 4 and Comparative Example 1 to the mean strain.

The inventors of the present invention have made intensive studies in order to reduce the iron loss, to increase the compact density, and to increase the magnetic flux density and, as a result, have obtained the following findings. Conventionally, in order to obtain more soft magnetic powder having a predetermined target particle size and, in some cases, to reduce the iron loss by forming the smaller particle size of the soft magnetic powder, long period pulverization has been carried out. However, the long period pulverization tends to introduce a strain into the iron based reduced powder and the iron based pulverized powder. The strain introduced into the iron based reduced powder and the iron based pulverized powder at the time of pulverization is not removed by operations such as classification and compacting. As a result, the strain remains in the obtained soft magnetic powder. The strain introduced by pulverization is difficult to be removed by the annealing of the compact. Even when the eddy current loss is reduced by compacting the soft magnetic powder having a smaller particle size, the hysteresis loss is increased more than the degree of the reduction in the eddy current loss and thus the iron loss is conversely increased. In addition, the soft magnetic powder to which the strain is introduced by pulverization is hardened. Therefore, a high compact density cannot be obtained by compacting the soft magnetic powder described above and thus the magnetic flux density is decreased.

Although the inventors of the present invention know decrease in the yield of the soft magnetic powder having a predetermined particle size, a powder magnetic core is compacted by pulverizing in a shorter period and collecting the soft magnetic powder having the predetermined particle size by the classification of the pulverized iron powder. As a result, the inventors of the present invention have found that excellent magnetic properties as a powder magnetic core can be obtained by this operation and thus have accomplished the present invention.

Hereinafter, the present invention will be described in detail.

1. Method for Producing Powder Magnetic Core

A first method for producing a powder magnetic core according to the present invention includes the step of compacting a first soft magnetic powder including soft magnetic powder particles that pass through a sieve having an opening of 75 μm being in a mass ratio of 95% mass or more relative to the whole amount of the soft magnetic powder, in which the soft magnetic powder has a mean strain of less than 0.100%. The powder magnetic core produced by the first production method is preferably applied for electromagnetic components used under a high drive frequency such as the core for an inductor (for example, a choke coil, a noise filter, and a reactor).

A second method for producing a powder magnetic core according to the present invention includes the step of compacting a second soft magnetic powder including soft magnetic powder particles that pass through a sieve having an opening of 600 μm being in a mass ratio of 98% mass or more relative to the whole amount of the soft magnetic powder, in which the soft magnetic powder has a mean strain of less than 0.050%. The powder magnetic core produced by the second production method is preferably applied for electromagnetic components used under a low drive frequency such as the rotor of a motor or the core of a stator.

Both of the first and second methods for producing the powder magnetic core of the present invention include the step of compacting the soft magnetic powder described below using a press machine and a die. Preferable condition of the pressure of a contacted surface in compacting is, for example, 490 MPa to 1960 MPa. As a compacting temperature, compacting at either room temperature or high temperature (for example, 100° C. to 250° C.) can be used.

When the soft magnetic powder is compacted, a lubricant can be further added to the soft magnetic powder. The effect of the lubricant can reduce friction resistance between powder particles or between the soft magnetic powder and the inner wall of a compacting die at the time of compacting the soft magnetic powder and thus the die galling of the compact and heat generation at the time of compacting can be prevented.

A conventional known lubricant can be used as the lubricant. Specific examples of the lubricant include metal salt powders of stearic acid such zinc stearate, lithium stearate, and calcium stearate; fatty acid amides such as polyhydroxy carboxylic acid amides, ethylene bis-stearic acid amide (ethylene bisstearylamide), and (N-octadecenyl) hexadecanoic acid amide; paraffin, wax and natural or synthetic resin derivatives. Among them, the fatty acid amides are preferable and, among the fatty acid amides, the polyhydroxy carboxylic acid amides and ethylene bis-stearic acid amide are preferable.

The lubricant is preferably contained in a mass ratio of 0.2% by mass to 1% by mass relative to the total amount of the soft magnetic powder. The mass ratio of the lubricant is more preferably 0.3% by mass or more and more preferably 0.4% by mass or more. If the lubricant is contained in a mass ratio of more than 1% by mass, the effect of the lubricant is saturated. When the amount of the lubricant is increased, the compact density is decreased, which deteriorates the magnetic properties. Therefore, the mass ratio of the lubricant is preferably 1% by mass or less, more preferably 0.9% by mass or less, and further preferably 0.8% by mass or less. At the time of compacting, when the compact is compacted after the lubricant is applied onto the inner wall of the die (die wall lubrication molding), the amount of the lubricant may be less than 0.2% by mass.

Subsequently, in the present invention, thermal treatment is applied to the compact to produce the powder magnetic core. By this thermal treatment, the strain introduced at the time of compacting is released and the hysteresis loss of the powder magnetic core caused by the strain introduced at the time of compacting can be reduced. A thermal treatment temperature at the time of compacting is preferably 400° C. or more, more preferably 450° C. or more, and further preferably 500° C. or more. The process is desirably carried out at higher temperature as long as the specific resistance does not deteriorate. When the thermal treatment temperature is more than 700° C., however, the insulating coating film may be broken. The breakdown of the insulating coating film is not preferable because the iron loss, particularly the eddy current loss increases and the specific resistance deteriorates. Therefore, the thermal treatment temperature is preferably 700° C. or less and more preferably 650° C. or less.

The atmosphere at the time of the thermal treatment is preferably a non-oxidized atmosphere. Examples of atmosphere gasses include nitrogen and noble gasses such as helium and argon. The thermal treatment can also be carried out in vacuo. A thermal treatment time is not particularly limited as long as the specific resistance does not deteriorate and preferably 20 minutes or more, more preferably 30 minutes or more, and further preferably 1 hour or more.

When the thermal treatment is carried out under conditions described above, the insulating coating film is difficult to break. Therefore, the powder magnetic core having high electrically insulating performance, that is, a high specific resistance can be produced without increasing the iron loss, particularly the eddy current loss (also corresponding to the coercive force).

After the thermal treatment, the powder magnetic core according to the present invention is obtained by cooling the powder magnetic core to room temperature.

2. Soft Magnetic Powder 2-1. Soft Magnetic Powder 2-1-1. First Soft Magnetic Powder The first soft magnetic powder of the present invention is a soft magnetic powder including soft magnetic powder particles that pass through a sieve having an opening of 75 μm being in a mass ratio of 95% by mass or more relative to the whole amount of the soft magnetic powder, in which the soft magnetic powder has a mean strain of less than 0.100%. The mass ratio of soft magnetic powder particles that pass through a sieve having an opening of 75 μm is preferably 96% by mass or more and more preferably 98% by mass or more. As the mass ratio of the soft magnetic powder particles that pass through a sieve having an opening of 75 μm is increased, that is, as the particle size of the soft magnetic powder particles is decreased, the iron loss, particularly the eddy current loss of the powder magnetic core produced by the production method of the present invention is effectively reduced even when the powder magnetic core is used for electromagnetic components used under a high drive frequency such as an inductor. The mean strain is preferably 0.097% or less, more preferably 0.090% or less, further preferably 0.080% or less, and particularly preferably 0.070% or less.

As the mean strain is decreased, the compact density and the magnetic flux density of the powder magnetic core produced by the first production method of the present invention are increased and thus the iron loss can be reduced.

The first soft magnetic powder of the present invention is preferably iron based particles having the insulating layers on the surfaces described below.

In addition, the mass ratio of the first soft magnetic powder particles of the present invention that do not pass through a sieve having an opening of 45 μm is preferably 40% by mass or more. The mass ratio of the soft magnetic powder particles that do not pass through the sieve having an opening of 45 μm is preferably 42% by mass or more. As the mass ratio of the soft magnetic powder particles that do not pass through the sieve having an opening of 45 μm is increased, the compact density can be increased because the particle size of the soft magnetic powder becomes more uniform and less strain is introduced at the time of pulverization. As a result, the magnetic flux density is increased and the iron loss is reduced, and thus the powder magnetic core having excellent magnetic properties can be produced.

2-1-2. Second Soft Magnetic Powder

The second soft magnetic powder of the present invention is a soft magnetic powder including soft magnetic powder particles that pass through a sieve having an opening of 600 μm being in a mass ratio of 98% by mass or more relative to the whole amount of the soft magnetic powder, in which the soft magnetic powder has a mean strain of less than 0.050%. The mass ratio of the soft magnetic powder particles that pass through the sieve having an opening of 600 μm is preferably 99% by mass or more. The second soft magnetic powder intends to be used for electromagnetic components used under a low drive frequency such as the core of a motor. Therefore, basically, the particle size of the soft magnetic powder is preferably large. However, when the particle size of the soft magnetic powder is excessively large, the soft magnetic powder is difficult to be filled in fine parts of the die. As a result, defect parts of the obtained powder magnetic core may be generated and the density may be decreased and fluctuated. Consequently, the mass ratio of the soft magnetic powder particles that pass through the sieve having an opening of 600 μm is 98% by mass or more relative to the whole amount of the soft magnetic powder. The mean strain is preferably 0.045% or less and more preferably 0.040% or less. As the mean strain is decreased, the compact density and the magnetic flux density of the powder magnetic core produced by the second production method of the present invention is increased and thus the iron loss can be reduced.

In addition, the mass ratio of the second soft magnetic powder particles of the present invention that do not pass through a sieve having an opening of 180 μm is preferably 20% by mass or more. As the mass ratio of the soft magnetic powder particles that do not pass through the sieve having an opening of 180 μm is increased, the compact density can be increased because the particle size of the soft magnetic powder is more uniform and less strain is introduced at the time of pulverization. As a result, the magnetic flux density is increased. The grain size in the particle is increased by increasing the particle size of the soft magnetic powder and thus the hysteresis loss can be decreased. By the above phenomena, the iron loss is reduced and thus the powder magnetic core having excellent magnetic properties can be produced.

2-2. Insulating Layer

The first and the second soft magnetic powders are preferably iron based particles having insulating layers on the surfaces of the iron based particles. Examples of constituents of the insulating layer include an insulating inorganic coating film and an insulating resin coating film. On the surface of the insulating inorganic coating film, the insulating resin coating film is preferably further formed. In this case, the total thickness of the insulating inorganic coating film and the insulating resin coating film is preferably 250 nm or less. When the thickness is more than 250 nm, reduction in the magnetic flux density may be significant.

2-2-1. Insulating Inorganic Coating Film

Examples of the insulating inorganic coating film include a phosphate conversion coating film, a chromium conversion coating film, a water glass coating film, and an oxide coating film. The phosphate conversion coating film is preferable. The insulating inorganic coating film may be formed by laminating two types or more of coating films. However, usually, the insulating inorganic coating film may be formed as a single layer.

The composition of the phosphate conversion coating film is not particularly limited as long as the coating film is an amorphous or a glass coating film formed by using a compound containing P. Other than P, the phosphate conversion coating film may contain one or more elements selected from, for example, Ni, Co, Na, K, S, Si, B, and Mg. These elements have the effect of suppressing reduction in the specific resistance by forming semiconductor with oxygen and Fe during the thermal treatment process.

The thickness of the phosphate conversion coating film is preferably about 1 nm to about 250 nm. When the film thickness is less than 1 nm, an insulating effect may not exert. When the film thickness is more than 250 nm, the insulating effect is saturated and the thickness is not also preferable from the viewpoint of increase in the density of the powder magnetic core. The film thickness is more preferably 10 nm to 50 nm.

2-2-2. Insulating Resin Coating Film

Examples of the insulating resin coating film include a silicone resin coating film, a phenol resin coating film, an epoxy resin coating film, a polyamide resin coating film, and a polyimide resin coating film. The insulating resin coating layer is preferably the silicone resin coating film. The insulating resin coating film may be formed by laminating two types or more of coating films. However, usually, the resin coating film may be formed as a single layer. In the present invention, the insulating property means that the specific resistance of the powder magnetic core is about 50 μΩ·m or more when the specific resistance is measured by a four-terminal method.

As the silicone resin used in the present invention, conventionally known silicone resin can be used. Examples of the commercially available silicone resin include KR261, KR271, KR272, KR275, KR280, KR282, KR285, KR251, KR155, KR220, KR201, KR204, KR205, KR206, KR225, KR311, KR700, SA-4, ES-1001, ES1001N, ES1002T, and KR3093 manufactured by Shin-Etsu Chemical Co., Ltd. and SR2100, SR2101, SR2107, SR2110, SR2108, SR2109, SR2115, SR2400, SR2410, SR2411, SH805, SH806A, and SH840 manufactured by Dow Corning Toray Co., Ltd. From the viewpoint of thermal stability, methylphenylsilicone resins (for example, KR225 and KR311 manufactured by Shin-Etsu Chemical Co., Ltd.) having 50 mol % or more of the methyl group are preferably used. Methylphenylsilicone resins (for example, KR300 manufactured by Shin-Etsu Chemical Co., Ltd.) having 70 mol % or more of the methyl group are more preferable. Methylsilicone resins (for example, SR2400 manufactured Dow Corning Toray Co., Ltd. and KR251, KR400, KR22OL, KR242A, KR240, KR500, and KC89 manufactured by Shin-Etsu Chemical Co., Ltd.) having no phenyl group are further preferable. Among them, SR2400 is the most preferable silicone resin.

The thickness of the silicone resin coating film is preferably 1 nm to 200 nm and more preferably 20 nm to 150 nm.

The silicone resin coating film may be further formed on the phosphate conversion coating film. By this process, at the time of completion of crosslink and hardening reaction of the silicone resin (at the time of compacting), the powder particles are strongly bonded with each other. In addition, Si—O bonds, which have excellent heat resistance, are formed to improve thermal stability of the insulating coating film.

2-3. Measurement Method of Strain

In the present invention, the mean strain can be measured by an X-ray diffraction method. The strain measured by X-ray is an average value of the strain of the whole soft magnetic powder because crystals are oriented in various directions in the soft magnetic powder. Therefore, the strain is not completely matched to a mechanical strain. However, the X-ray diffraction method enables a sample to be measured in a nondestructive manner as long as the sample is a powder material, and has excellent repeatability and quantitatively. Therefore, the strain of the soft magnetic powder is preferably measured by the X-ray diffraction method.

The X-ray diffraction method is a method for measuring an atomic distance by using a relationship that a diffraction angle 2θ and a diffraction plane spacing d corresponding to the atomic distance in the soft magnetic powder satisfies given by the following Bragg equation:

$$\lambda=2d\cdot\sin\theta \quad (1)$$

when an X ray having a constant wavelength λ is incident to the soft magnetic powder. Each substance has its own specific diffraction plane spacing depending on types of atoms constituting the substance and the crystal structure of the substance and thus the substance can be identified by the X-ray diffraction method.

When the strain is introduced into the soft magnetic powder, the atomic distance d is also changed in the soft magnetic powder and thus the diffraction angle 2θ to the X ray having a wavelength λ is changed accompanying with the change in the atomic distance d. Therefore, a degree of the strain introduced into the soft magnetic powder can be calculated by using the Bragg equation represented by the above equation (1).

For example, the mean strain can be calculated by the following method. First, for a diffraction angle to the wavelength λ characteristic to the soft magnetic powder, the value of the diffraction angle when no strain exists is determined as $2\theta_{\alpha 0}$. In an X ray diffraction spectrum obtained by X ray diffraction measurement of the soft magnetic powder, a diffraction plane spacing d is calculated using the Bragg equation across the half width of the peak derived from $2\theta_{\alpha 0}$ and an amount of displacement:

[Formula 1]

$$|d-d_{\alpha 0}| \quad (2)$$

is calculated from a diffraction plane spacing $d_{\alpha 0}$ corresponding to the diffraction angle $2\theta_{\alpha 0}$. Subsequently, an average value:

[Formula 2]

$$|d-d_{\alpha 0}| \quad (3)$$

is calculated across the half width of the peak derived from $2\theta_{\alpha 0}$. Then, the averaged value is converted into a dimensionless value using the following formula:

[Formula 3]

$$|d-d_{\alpha 0}|/d \quad (4)$$

The dimensionless value is represented by percentage to determine the mean strain.

The strain introduced into the soft magnetic material can be controlled by adequately adjusting the particle size of the iron based raw material powder, the reduction annealing temperature in the reduction annealing process, and the pulverization yield in the pulverization process described below.

3. Method for Producing Soft Magnetic Powder 3-1. Iron Based Raw Material Powder The iron based raw material powder that is a raw material powder for producing the soft magnetic powder is a ferromagnetic iron based powder. Specific examples of the iron based raw material powder include a pure iron powder, an iron based alloy powder (for example, Fe—Al alloy, Fe—Si alloy, sendust, and permalloy) and an iron based amorphous powder.

The iron based raw material powder can be produced by, for example, an atomizing method (a gas atomizing method and a water atomizing method) and a pulverization method. The obtained powder may be pre-reduced, if needed. For example, before the reduction annealing process, an atomizing process of forming an iron oxide based powder from molten metal being an iron based raw material by the water atomizing method and pre-reduction process of pre-reducing the iron oxide based powder to obtain the iron based raw material powder may be further included. In this case, the iron based raw material powder may be reduced with annealing by heating the iron based raw material powder obtained by the pre-reduction process under a reducing atmosphere in the reduction annealing process.

It has been known that sintering progresses by the surface energy as driving force in the reduction annealing described below. Generally, as the particle size is decreased, the surface area of the power is increased in the powder material such as the iron based raw material powder. Therefore, when the particle size of the iron based raw material powder is excessively small, the surface energy is excessively high. This may cause excessive progress of sintering for which the surface energy acts as the driving force. If the sintering excessively progresses, the strain introduced into the soft magnetic powder in the pulverization process described below is increased, which is not preferable.

Based on this viewpoint, when the first soft magnetic powder being a soft magnetic powder including soft magnetic powder particles that pass through a sieve having an opening of 75 being in a mass ratio of 95% by mass or more, in which the soft magnetic powder has a mean strain of less than 0.100% is intended to be obtained, the particle size of the iron based raw material powder for producing the first soft magnetic powder is preferably a particle size in which the mass ratio of iron based raw material powder particles that pass through the sieve having an opening of 75 μm is 90% by mass or more and iron based raw material powder particles that pass through a sieve having an opening of 45 μm is 60% by mass or less relative to the whole amount of the iron based raw material powder. When the amount of the iron based raw material powder having large particle size is excessively large, the yield is decreased, while when the amount of the iron based raw material powder having small particle size is excessively large, sintering in the reduction process excessively progresses and thus more power is required for pulverization and the strain is easy to be generated.

Similarly, when the second soft magnetic powder being a soft magnetic powder including soft magnetic powder particles that pass through a sieve having an opening of 600 μm being in a mass ratio of 98% by mass or more, in which the soft magnetic powder has a mean strain of less than 0.050% is intended to be obtained, the particle size of the iron based raw material powder for producing the second soft magnetic powder is preferably a particle size in which the mass ratio of iron based raw material powder particles that pass through the sieve having an opening of 600 μm is 99% by mass or more and iron based raw material powder particles that pass through a sieve having an opening of 45 μm is 30% by mass or less relative to the whole amount of the iron based raw material powder.

3-2. Reduction Annealing Process

In the reduction annealing process, the iron based powder material is reduced with annealing by heating the iron based raw material powder under a reducing atmosphere. The atmosphere when the iron based raw material powder is reduced with annealing is recommended to be a reducing atmosphere. Examples of the reducing atmosphere include a hydrogen gas atmosphere and a mixed gas atmosphere in which hydrogen gas and inert gas (for example, nitrogen gas and argon gas) are mixed.

At this time, adjacent iron based raw material powder particles are fused and bonded with each other by sintering to form the iron based reduced powder obtained by the reduction annealing in the form of a sintering product such as sheet-like product or a block-like product.

The lower limit of a reduction annealing temperature when the iron based raw material powder is reduced with annealing is not particularly limited. For example, the reduction annealing is preferably carried out at 900° C. or more. When the reduction annealing is carried out at a temperature of 900° C. or more, the grain size in the iron based raw material powder and the iron based reduced powder can be coarsened and thus the hysteresis loss of the powder magnetic core can be reduced. The reduction annealing temperature is preferably 930° C. or more and further preferably 950° C. or more. However, the reduction annealing temperature is excessively high, the sintering excessively progresses. As a result, a large amount of energy is required for pulverization, which is industrially disadvantageous. When the sintering excessively progresses, a high strain is introduced into the iron based reduced powder in the pulverization process described below and thus the soft magnetic powder having a predetermined strain in the predetermined particle size cannot be obtained. Therefore, in order to produce the first and the second soft magnetic powders of the present invention, the heating temperature is preferably 1250° C. or less and more preferably 1200° C. or less.

3-3. Pulverization Process

The pulverization process including the steps of pulverizing the iron based reduced powder formed by carrying out the reduction annealing in the reduction annealing process, classifying the pulverized powder, and mixing the powder having the desired particle size in the predetermined ratio to obtain iron based particles. The iron based particles obtained by classifying the pulverized powder can be used as the soft magnetic powder without further treatment or can be used as the soft magnetic powder after insulating layers are formed on the surfaces of the iron based particles. From the viewpoint of reduction in the iron loss, particularly in the eddy current loss, the insulating layers are preferably formed on the surfaces of the iron based particles.

The iron based reduced powder forms the sintering product such as a sheet-like product or a block-like product as a result of fusing and bonding the iron based raw material powder particles with each other. Methods for pulverizing the iron based reduced powder are not particularly limited and known crushing machines and powdering machines (for example, a feather mill, a hammer mill, and a pulverizer) can be used in an appropriate combination.

3-3-1. First Soft Magnetic Powder

When the first soft magnetic powder is intended to be obtained, the pulverization of the iron based reduced powder is carried out so that a pulverization yield (75 μm) is 95% by mass or more and a pulverization yield (45 μm) is 60% by mass or less. At this time, the iron based pulverized powder particles that pass through a sieve having an opening of 75 μm is collected as the iron based particles of the present invention. The pulverization yield (75 μm) means the mass ratio of the iron based particles after pulverization that pass through the sieve having an opening of 75 μm relative to the whole iron based reduced powder before pulverization that is supplied to the pulverization process. For the first soft magnetic powder, the pulverization yield (45 μm) means the mass ratio of the iron based particles that pass through a sieve having an opening of 45 μm relative to the powder having a particle size of 75 μm or less obtained by the pulverization process. When the pulverization yield (75 μm) and pulverization yield (45 μm) are within the above ranges, the obtained first soft magnetic powder includes soft magnetic powder particles that pass through the sieve having an opening of 75 μm being in a mass ratio of 95% by mass or more relative to the whole amount of the soft magnetic powder, in which the soft magnetic powder has a mean strain of less than 0.100%.

When the first soft magnetic powder is intended to be obtained, the pulverization yield (75 μm) is preferably 96% by mass or more and more preferably 98% by mass or more. The pulverization yield (45 μm) is preferably 60% by mass or less and more preferably 58% by mass or less. When the pulverization yield (45 μm) is more than 60% by mass, a high strain is introduced into the soft magnetic powder. This is not preferable because the high strain causes increase in the iron loss, particularly the hysteresis loss of the powder magnetic core, decrease in the compact density, and decrease in the magnetic flux density. When the pulverization yield (75 μm) is less than 95% by mass, the pulverization yield is low, that is, a pulverization yield ratio is low. This is not preferable because the low pulverization yield ratio is industrially disadvantageous.

3-3-2. Second Soft Magnetic Powder

When the second soft magnetic powder is intended to be obtained, the pulverization of the iron based reduced powder is carried out so that a pulverization yield (600 μm) is 98% by mass or more and a pulverization yield (45 μm) is 5% by mass or less. At this time, the iron based pulverized powder particles that pass through a sieve having an opening of 600 μm is collected as the iron based particles of the present invention. The pulverization yield (600 μm) means the mass ratio of the iron based particles that pass through the sieve having an opening of 600 μm relative to the whole iron based reduced powder before pulverization that is supplied to the pulverization process. For the second soft magnetic powder, the pulverization yield (45 μm) means the mass ratio of the iron based particles that pass through a sieve having an opening of 45 μm relative to the powder having a particle size of 600 μm or less obtained by the pulverization process. When the pulverization yield (600 μm) is within the above range, the obtained first soft magnetic powder includes soft magnetic powder particles that pass through the sieve having an opening of 600 μm being in a mass ratio of 98% by mass or more relative to the whole amount of the soft magnetic powder, in which the soft magnetic powder has a mean strain of less than 0.050%.

When the second soft magnetic powder is intended to be obtained, the pulverization yield (600 μm) is more preferably 99% by mass or more. The pulverization yield (45 μm) is preferably 5% by mass or less and more preferably 2% by mass or less. When the pulverization yield (45 μm) is more than 5% by mass, a high strain is introduced into the soft magnetic powder. This is not preferable because the high strain causes increase in the iron loss, particularly the hysteresis loss of the powder magnetic core, decrease in the compact density, and decrease in the magnetic flux density. When the pulverization yield (600 μm) is less than 98% by mass, the pulverization yield is low, that is, a pulverization yield ratio is low. This is not preferable because the low pulverization yield ratio is industrially disadvantageous.

3-4. Insulating Layer Forming Process 3-4-1. Method for Forming Phosphate Conversion Coating Film A powder for forming the phosphate conversion coating film used in the present invention may be produced by any mode. For example, the powder for forming the phosphate conversion coating film can be obtained by mixing a solution in which a compound containing P is dissolved in a solvent made of water and/or an organic solvent and a coarsened soft magnetic iron based powder, and thereafter evaporating the solvent, if needed. Examples of the solvent used in this process include water, a hydrophilic organic solvent such as an alcohol and a ketone, and a mixture thereof. A known surfactant can be added to the solvent. Examples of the compound containing P include orthophosphoric acid ($H_3PO_4$) and salts thereof.

3-4-2. Method for Forming Silicone Resin Coating Film

The silicone resin coating film can be formed by, for example, mixing a silicone resin solution in which a silicone resin is dissolved in an alcohol or a petroleum organic solvent such as toluene and xylene and the soft magnetic iron based powder, and thereafter evaporating the organic solvent, if needed. As the soft magnetic iron based powder, a soft magnetic iron based powder having a phosphate conversion coating film (a powder for forming the phosphate conversion coating film) is preferable.

EXAMPLES

Hereinafter, the present invention will be more specifically described with reference to Examples. However, the present invention is not basically limited by Examples and can be obviously carried out by appropriately modifying within a scope adaptable to the purposes described above and below. Any of these modifications are included in the technical scope of the present invention. Hereinafter, "parts" means "parts by mass" and "%" means "% by mass", unless otherwise noted.

The soft magnetic iron based powders described below were prepared and powder magnetic cores were produced according to the procedure described below.

Production of Iron Based Particles

Inventive Examples 1 to 4 and Comparative Example 1

A pure iron powder was prepared as an iron based raw material powder and adjusted so that the mass ratio of the pure iron powder particles that pass through a sieve having an opening of 75 μm was 95% by mass or more and a mass ratio of the pure iron powder particles that pass through a sieve having an opening of 45 μm was 52% by mass. The iron based raw material powder was reduced with annealing at reduction annealing temperatures shown in Table 2. The obtained iron based reduced powders were pulverized by using various machines so that the pulverization yields (45 μm) shown in Table 1 were obtained and the iron based pulverized powder particles that pass through the sieve having an opening of 75 μm were collected to obtain the iron based particles.

Inventive Examples 5 and 6 and Comparative Example 2

A pure iron powder was prepared as an iron based raw material powder and adjusted so that the mass ratio of the pure iron powder particles that pass through a sieve having an opening of 600 μm was 99% by mass and the mass ratio of the pure iron powder particles that pass through a sieve having an opening of 45 was 6.2% by mass. The iron based raw material powder was reduced with annealing at reduction annealing temperatures shown in Table 3. The obtained iron based reduced powders were pulverized by using various machines so that the pulverization yields (45 μm) shown in Table 1 were obtained and the iron based pulverized powder particles that pass through the sieve having an opening of 600 μm were collected to obtain the iron based particles.

The iron based particles in Inventive Examples 1 to 6 and Comparative Examples 1 and 2 obtained by the above processes were measured by powder X ray diffraction to measure mean strains. The powder X ray diffraction measurement apparatus and measurement conditions are shown in Table 1.

TABLE 1

| | | |
|---|---|---|
| Analysis apparatus | X ray diffraction apparatus RAD-RU300, manufactured by Rigaku Corporation | |
| Analysis conditions | Target | Co |
| | Monochromatization | Monochromator is used (Kα line) |
| | Target output (X-ray tube voltage-current) | 40 kV-200 mA |
| | (Continuous measurement) | θ/2θ scan |
| | Slit | Diffusion 1°, scattering 1°, and light receiving 0.15 mm |
| | Monochromator light receiving slit | 0.6 mm |
| | Scan rate | 1°/min |
| | Sampling width | 0.012° |
| | Measurement angle | 30°~140° |

(Production of Iron Based Particles)

Subsequently, to the surfaces of the obtained iron based particles of Inventive Examples 1 to 6 and Comparative Examples 1 and 2, insulating inorganic coating films and insulating resin coating films were formed in this order (the insulating inorganic coating films were formed on the iron based particle side and the insulating organic coating films were formed outside of the insulating inorganic coating film) as insulating layers. A phosphate conversion coating film was formed as the insulating inorganic coating film and a silicone resin coating film was formed as the insulating resin coating film.

For forming the phosphate conversion coating film, a treatment liquid made by mixing 50 parts of water, 30 parts of $NaHPO_4$, 10 parts of $H_3PO_4$, 10 parts of $(NH_2OH)_2$. $H_2SO_4$, and 10 parts of $Co_3(PO_4)_2$ and diluting the mixed liquid 20 times with water was used as a treatment liquid for the phosphate conversion coating film. The thickness of the phosphate conversion coating film was 10 nm to 100 nm.

For forming the silicone resin coating film, a resin solution prepared by dissolving the silicone resin "SR2400" (manufactured by Dow Corning Toray Co., Ltd.) into toluene and having a resin solid concentration of 5% was used.

The thickness of the silicone resin coating film was 100 nm to 150 nm.

Subsequently, each soft magnetic powder on which the two layers of the insulating layers (the phosphate conversion coating film was formed on the iron based particle side and the silicone resin coating film was formed outside of the phosphate conversion coating film) were formed was formed (hereinafter may be referred to as an "insulating coating soft magnetic powder") and each powder magnetic core was produced. The powder magnetic core was produced by dispersing zinc stearate in an alcohol, applying the dispersion onto the surface of a die, placing the insulating coating soft magnetic powder in the die, and forming the powder magnetic core using a press machine at a temperature condition of 130° C. and a contact pressure of 1177.5 MPa (12 ton/cm$^2$). The shape of the compact was a sheet-like shape having a length of 31.75 mm, a width of 12.7 mm, and a thickness of 5 mm.

Thermal treatment was carried out to the obtained sheet-like compact under a nitrogen atmosphere at 600° C. for 30 minutes. Here, the temperature rising rate was 10° C./min when the compact was heated from room temperature to 600° C. After the thermal treatment, the compact was slowly cooled in the oven.

The compact densities of the powder magnetic core are shown in Tables 2 and 3. The correlation of the compact density and the mean strain of the powder magnetic cores prepared by using the soft magnetic powders in the Inventive Examples 1 to 4 and Comparative Example 1 is illustrated in FIG. 1 and the correlation of the compact density and the mean strain of the powder magnetic cores prepared by using the soft magnetic powders in the Inventive Examples 5 and 6 and Comparative Example 2 is illustrated in FIG. 2.

The iron losses of the measurement samples were measured by using an alternating current B—H analyzer at a maximum magnetic flux density of 0.1 T and a frequency of 10 kHz. Specific resistances were also measured at the same time.

These measurement results are collectively shown in Tables 2 and 3. The correlation of the iron loss and the mean strain of the powder magnetic cores prepared by using the first soft magnetic powder is illustrated in FIG. 3.

Figure 2:
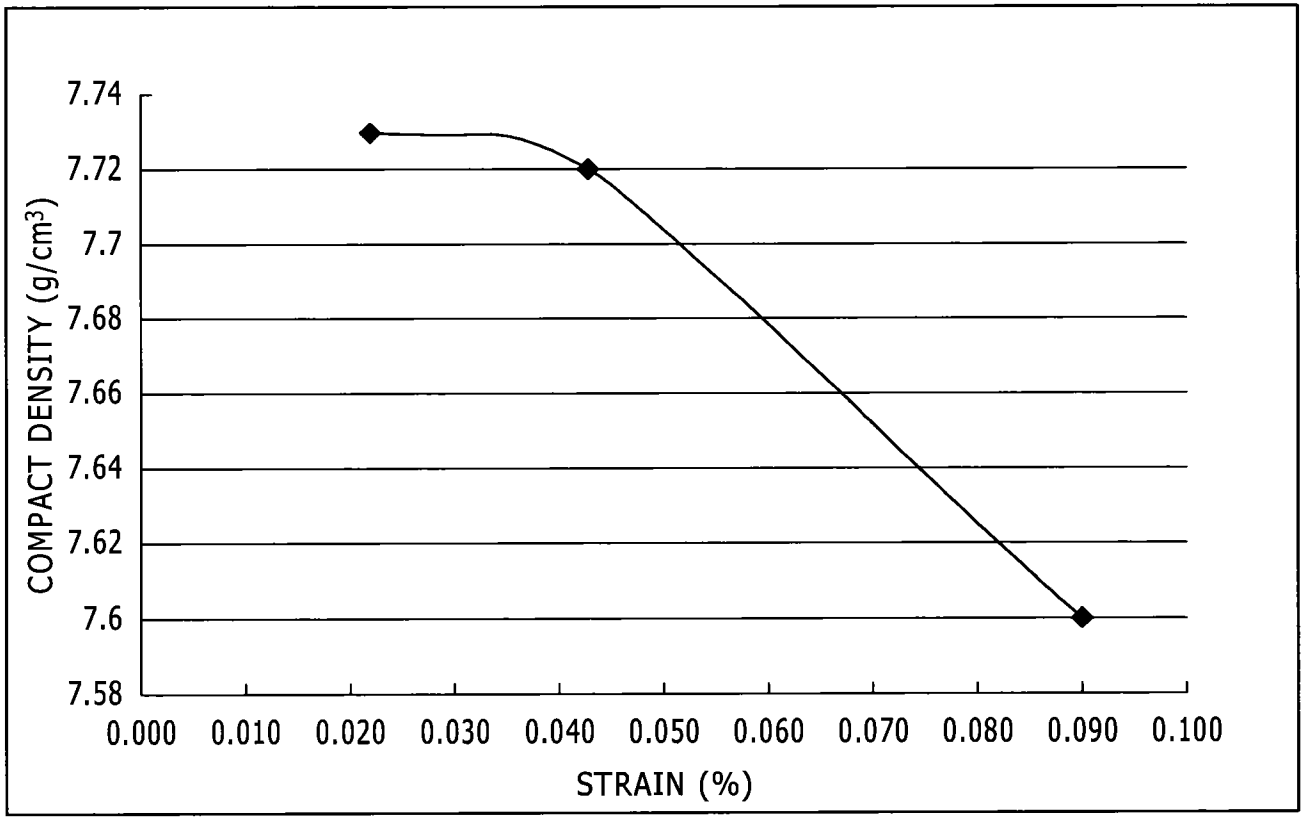
FIG. 2 is a graph obtained by plotting the compact density of powder magnetic cores obtained in Inventive Examples 5 and 6 and Comparative Example 2 to the mean strain.
Figure 3:
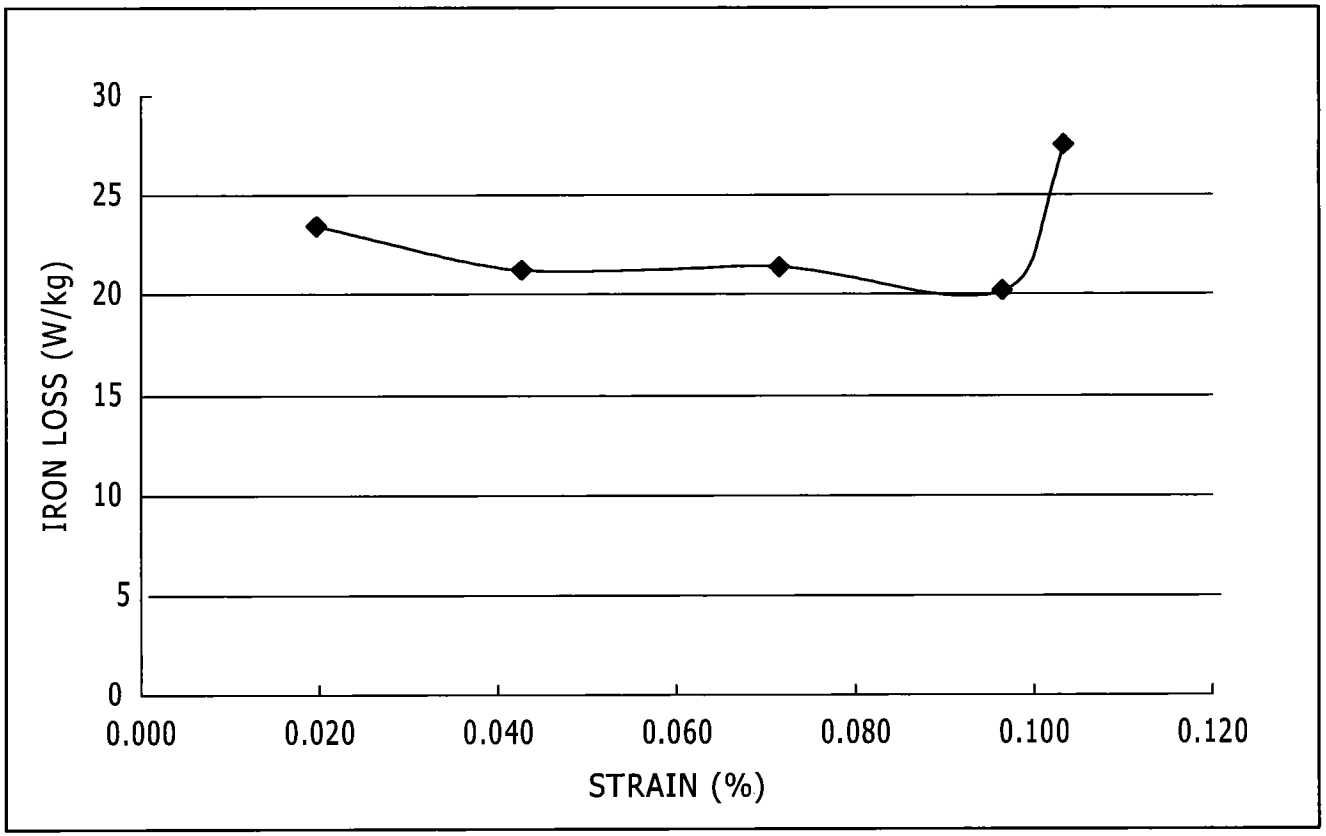
FIG. 3 is a graph obtained by plotting the iron loss of powder magnetic cores obtained in Inventive Examples 1 to 4 and Comparative Example 1 to the mean strain.

From Table 2 and FIGS. 1 and 3, the following consideration can be made.

Inventive Examples 1 to 4 are the inventive examples that satisfy the requirements defined in the present invention and are the powder magnetic cores produced by using the first soft magnetic powder including soft magnetic powder particles that pass through a sieve having an opening of 75 μm being in a mass ratio of 95% by mass or more, in which the soft magnetic powder has a mean strain of less than 0.100%. Therefore, the powder magnetic cores have the high compact densities and the reduced iron losses.

On the other hand, the powder magnetic core in Comparative Example 1 is produced by using the soft magnetic powder including soft magnetic powder particles that pass through a sieve having an opening of 75 μm being in a mass ratio of 95% by mass or more, while the mean strain is 0.104%. As a result, the compact density was decreased and the iron loss was increased. When Inventive Examples 1 to 4 are compared with Comparative Example 1, it is found that the powder magnetic cores having excellent magnetic properties can be obtained by producing the powder magnetic cores using the soft magnetic powders having reduced strains even when values of the particle size are almost equal.

From Table 3 and FIG. 2, the following consideration can be made.

Inventive Examples 5 and 6 are the inventive examples that satisfy the requirements defined in the present invention. The powder magnetic cores are produced by using the second soft magnetic powder including soft magnetic powder particles that pass through a sieve having an opening of 600 μm being in a mass ratio of 98% by mass or more, in which the soft magnetic powder has a mean strain of less than 0.050% and thus a high compact density is obtained. Therefore, the powder magnetic cores have high magnetic flux densities and the reduced iron losses.

On the other hand, the powder magnetic core in Comparative Example 2 is produced by using the soft magnetic powder including soft magnetic powder particles that pass through a sieve having an opening of 600 μm being in a mass ratio of 95% by mass or more, while the mean strain is 0.090. The result indicates that the compact density was decreased. When Inventive Examples 5 and 6 are compared with Comparative Example 2, it is found that the powder magnetic cores having excellent magnetic properties can be obtained by producing the powder magnetic cores using the soft magnetic powders having reduced strains even when values of the particle size are almost equal.

The present invention is described in detail with reference to specific Examples. However, it is obvious to those skilled in the art that various changes and modifications can be applied without departing from the spirit and scope of the present invention.

TABLE 2

| | | | Inventive Example 1 | Inventive Example 2 | Inventive Example 3 | Inventive Example 4 | Comparative Example 1 |
|---|---|---|---|---|---|---|---|
| Powder | Reduction temperature | ° C. | 970 | 1200 | 970 | 1200 | 970 |
| | Pulverization equipment | | Feather mill | Feather mill | Pulverizer | Pulverizer | Roller mill |
| | Pulverization yield (45 μm) | % | 50 | 56 | 47 | 58 | 66 |
| | Strain | % | 0.020 | 0.043 | 0.072 | 0.097 | 0.104 |
| Compact | Compact density | g/cm$^3$ | 7.58 | 7.63 | 7.57 | 7.57 | 7.19 |
| | Iron loss | W/kg | 23.5 | 21.3 | 21.4 | 20.2 | 27.4 |
| | Electric resistance | μΩ/m | 596 | 1099 | 274 | 357 | 539 |

TABLE 3

| | | | Inventive Example 5 | Inventive Example 6 | Comparative Example 2 |
|---|---|---|---|---|---|
| Powder | Reduction temperature | ° C. | 970 | 1200 | 970 |
| | Pulverization equipment | | Feather mill | Pulverizer | Roller mill |
| | Pulverization yield (45 μm) | % | 1.5 | 3.5 | 6.2 |
| | Strain | % | 0.022 | 0.043 | 0.090 |
| Compact | Compact density | g/cm$^3$ | 7.73 | 7.72 | 7.6 |

This application is based on Japanese Patent Application filed on Aug. 31, 2012 (Japanese Patent Application Publication No. 2012-192146); the contents of which are incorporated herein by reference.

INDUSTRIAL APPLICABILITY

The powder magnetic core of the present invention has excellent magnetic properties, particularly a reduced iron loss and a high magnetic flux density due to a high density and thus is suitable for electromagnetic components such as an inductor and a motor.

The invention claimed is:

1. A method for producing a powder magnetic core, the method comprising:

compacting a soft magnetic powder that comprises 95% by mass or more of soft magnetic powder particles that pass through a sieve having an opening of 75 μm based on the total amount of the soft magnetic powder, and 40% by mass or more of soft magnetic powder particles based on the total amount of the soft magnetic powder do not pass through a sieve having an opening of 45 μm, wherein the soft magnetic powder has a mean strain of less than 0.100%.

2. The method for producing the powder magnetic core according to claim 1, wherein the soft magnetic powder is iron based particles having at least one insulating layer on the surface of the iron based particles.

3. The method for producing the powder magnetic core according to claim 1, wherein the powder magnetic core is a core of an inductor.

4. A soft magnetic powder for a powder magnetic core comprising soft magnetic powder particles, wherein the soft magnetic powder comprises 95% by mass or more of soft magnetic powder particles that pass through a sieve having an opening of 75 μm based on the total amount of the soft magnetic powder; and 40% by mass or more of soft magnetic powder particles based on the total amount of the soft magnetic powder do not pass through a sieve having an opening of 45 μm, and wherein the soft magnetic powder has a mean strain of less than 0.100%.

5. The soft magnetic powder for the powder magnetic core according to claim 4, wherein the soft magnetic powder is iron based particles having at least one insulating layer on the surface of the iron based particles.

6. A method for producing a powder magnetic core, the method comprising:

compacting a soft magnetic powder comprising 98% by mass or more of soft magnetic powder particles that pass through a sieve having an opening of 600 μm based on the total amount of the soft magnetic powder, and wherein the soft magnetic powder has a mean strain of less than 0.050%.

7. The method for producing the powder magnetic core according to claim 6, wherein the soft magnetic powder is iron based particles having at least one insulating layer on the surface of the iron based particles.

8. The method for producing the powder magnetic core according to claim 6, wherein the powder magnetic core is a rotor of a motor or a core of a stator.

9. A soft magnetic powder for a powder magnetic core comprising soft magnetic powder particles, wherein the soft magnetic powder comprises 98% by mass or more of soft magnetic powder particles that pass through a sieve having an opening of 600 μm based on the total amount of the soft magnetic powder; and wherein the soft magnetic powder has a mean strain of less than 0.050%.

10. The soft magnetic powder for the powder magnetic core according to claim 9, wherein the soft magnetic powder is iron based particles having at least one insulating layer on the surface of the iron based particles.

11. The method for producing a powder magnetic core of claim 1, further comprising adding a lubricant to the soft magnetic powder.

12. The method for producing a powder magnetic core of claim 11, wherein the lubricant is at least one selected from the group consisting of a metal salt powder of stearic acid, fatty acid amide, paraffin, wax and a natural or synthetic resin derivative.

13. The method for producing a powder magnetic core of claim 11, wherein a content of the lubricant is form 0.2% by mass to 1% by mass based on the total amount of the soft magnetic powder.

14. The method for producing a powder magnetic core of claim 1, further comprising thermal treatment of the compacted soft magnetic powder at 400° C. to 700° C.

15. The method for producing a powder magnetic core of claim 14, wherein the thermal treatment is conducted for 20 minutes or more at a non-oxidized atmosphere.

16. The method for producing a powder magnetic core of claim 6, wherein 20% by mass or more of the soft magnetic powder particles do not pass through a sieve having an opening of 180 μm.

17. The method for producing a powder magnetic core of claim 1, wherein the soft magnetic powder particles have an insulating inorganic coating film and an insulating resin coating film on the surface that have a total thickness of 250 nm or less.

18. The method for producing a powder magnetic core of claim 7, wherein the soft magnetic powder particles have an insulating inorganic coating film and an insulating resin coating film on the surface that have a total thickness of 250 nm or less.

19. The method for producing a powder magnetic core of claim 9, wherein the soft magnetic powder particles have an insulating inorganic coating film and an insulating resin coating film on the surface that have a total thickness of 250 nm or less.

* * * * *